US010603774B2

(12) United States Patent
Hoback

(10) Patent No.: US 10,603,774 B2
(45) Date of Patent: Mar. 31, 2020

(54) LEVERAGE ENHANCEMENT ATTACHMENT FOR LEVER TOOLS

(71) Applicant: John F Hoback, Soldotna, AK (US)

(72) Inventor: John F Hoback, Soldotna, AK (US)

( * ) Notice: Subject to any disclaimer, the term of this patent is extended or adjusted under 35 U.S.C. 154(b) by 178 days.

(21) Appl. No.: 15/784,120

(22) Filed: Oct. 14, 2017

(65) Prior Publication Data

US 2019/0111554 A1 Apr. 18, 2019

(51) Int. Cl.

| | |
|---|---|
| ***B25D 1/04*** | (2006.01) |
| ***B25D 1/06*** | (2006.01) |
| ***B25C 11/00*** | (2006.01) |
| ***B25F 1/04*** | (2006.01) |

(52) U.S. Cl.

CPC ..... *B25D 1/045* (2013.01); *B25C 11/00* (2013.01); *B25D 1/06* (2013.01); *B25F 1/04* (2013.01); *B25D 2250/105* (2013.01)

(58) Field of Classification Search

CPC .. B25C 11/00; B25D 1/06; B25D 1/04; B25D 1/045; B25D 2250/045; B25D 2250/171; B25F 1/006

See application file for complete search history.

(56) References Cited

U.S. PATENT DOCUMENTS 551,993 A * 12/1895 Norton ..... B25D 1/04 254/26 R
1,792,437 A * 2/1931 Metzger ..... B25D 1/00 254/26 R
2,110,057 A * 3/1938 Scheurer ..... B25D 1/045 254/26 R
2,365,463 A * 12/1944 Formhals ..... B25D 1/045 254/26 R
2,527,738 A * 10/1950 Kirk ..... B25D 1/045 254/26 R
2,539,860 A * 1/1951 Ralston ..... B25D 1/04 254/26 R
2,747,835 A * 5/1956 Belgard ..... B25D 1/045 254/26 E
3,138,364 A * 6/1964 Cory ..... B25D 1/045 254/26 R
4,422,620 A * 12/1983 Nitzberg ..... B25D 1/045 254/26 E
5,060,911 A * 10/1991 Mikesell ..... B25C 11/00 254/26 E
5,249,776 A * 10/1993 Johnson ..... B25D 1/045 254/26 E
6,682,048 B2 * 1/2004 Weber ..... B25C 11/00 254/1
6,978,503 B2 * 12/2005 Del Cogliano ..... B25D 1/045 7/143
7,051,998 B2 * 5/2006 Sleiman ..... B25D 1/045 254/26 E
7,163,195 B2 * 1/2007 Lawson ..... B25C 11/00 254/1

(Continued)

*Primary Examiner* — Michael C McCullough

(57) ABSTRACT

A compression strength attachment block has a tension strength attachment loop pivotally attached to the block. The loop hooks around a lever tool adjacent to a working end for enhanced attack angle and increased leverage in fastener extraction, prying, and lifting work. Magnets on a tool attachment face assist in aligning and holding the block to the lever tool. End magnets hold fasteners after extraction or before insertion. Recesses in the block contain or retain other working tools.

13 Claims, 4 Drawing Sheets

(56) References Cited

U.S. PATENT DOCUMENTS

| | | | | |
|---|---|---|---|---|
| 8,113,091 | B2 * | 2/2012 | Chen | B25D 1/04 81/20 |
| 8,366,075 | B1 * | 2/2013 | Provines | B25C 11/00 254/131 |
| 10,183,389 | B1 * | 1/2019 | Annunziata | B25D 1/10 |
| 2015/0026898 | A1 * | 1/2015 | Arvinte | A47L 13/022 7/105 |

* cited by examiner

LEVERAGE ENHANCEMENT ATTACHMENT FOR LEVER TOOLS

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

Field of the Invention

The present invention relates to lever tools in particular to a leverage enhancement attachment for any of a variety of lever tools to provide a variable attack angle and increased leverage power of the lever tools thereby increasing force applied to a work element to enable performing tasks requiring greater force than normally possible with the lever tools alone and greater ease in performing all tasks.

Description of Related Art Including Information Disclosed Under 37 CFR 1.97 and 1.98

Many existing lever tools provide a claw or indent or tapering edge, such as on the head of a claw hammer or on a curved end of a crowbar, for removing nails, spikes, screws, or other connector types of fasteners from their installed position attaching two or more elements together and other types of lever tools provide a tapered work end for insertion between surfaces to facilitate relative movement for separation or lifting or adjustable support.

Removing fasteners, particularly those that have been connected for a long time, can be a daunting task often damaging the members that are attached together or even damaging the extractor tool in the process or failing to remove the fasteners because the extractor tool itself lacks a sufficiently steep angle of attack or leverage due to the structure or shape of the extractor tool.

Lifting heavy loads or separating attached work components or adjustably lifting heavy or cumbersome work elements can be difficult or impossible with a standard lever tool or lever bar.

Prior art attempts to solve the problem were often built into a single hammer or other tool at a greater expense for the tool and were only able to be used with the extractor tool to which they were attached. Other prior art devices were large and unwieldy and not easily carried in a tool box or tool belt.

U.S. Pat. No. 4,422,620 issued 27 Dec. 1983 to Nitzberg, shows an adjustable fulcrum hammer with a handle having a grip at one end, a head fixed about the other end, a fulcrum rod extending into the hollow interior of the handle through a bore in the head, an elastomeric member on the end of the rod remote from the head for contacting a fulcrum surface, a set screw extending the handle between its ends for locking the fulcrum rod in any desired position and a spring mounted within the handle for urging the rod outward. In another embodiment of the present invention, a locking mechanism is integrally provided by cooperating threads which disengage and allow for reciprocal movement when the fulcrum member is rotated a quarter-turn.

U.S. Pat. No. 6,682,048 issued 27 Jan. 2004 to Weber, provides a cam that when positioned next to a nail which is engaged with the claw of a claw hammer will keep the prying fulcrum of the hammer at the level of the head of the nail as the hammer rotates along the cam and pulls the nail upward with a force directed along the axis of the nail. The cam is provided with a handle that serves as an aid in positioning the cam and also an aid to placing the cam in and removing the cam from a craftsman's personal carrier. The handle also can serve as a straight edge, a scale, a scribing guide, a pry, and a tack and brad pulling aid. The handle and the cam together can serve as a square. The cam can be provided with a slot which a partially pulled nail can enter so that the hammer can regain a mechanical advantage and to press against the work surface and protect it from damage from the nail being pulled from the work surface.

U.S. Pat. No. 7,051,998 issued 30 May 2006 to Sleiman, claims a selectively operable extendable fulcrum device is described. The device includes a casing with a slot to selectively guide and lock a selectively telescoping rod into place when extended. A ridge on the inside of the casing provides a resting place for a compression spring. The compression spring is operable to selectively retract the telescoping rod back into its retracted position and keeps the telescoping rod and fulcrum head assembly securely in place when retracted. The fulcrum head provides added leverage needed to pull out nails from materials when it is retracted as well as providing added leverage for longer nails when the fulcrum head is extended. The casing and the associated components of the device can be press fit into any conventional hammer head member.

U.S. Pat. No. 7,163,195 issued 16 Jan. 2007 to Lawson, discloses a displaced force backing wedge with a rigid wedge shape, a rigid handle, the wedge shape having a plurality of rounded ridges extending from left to right at its top most surface. The wedge shape has a centrally located slot extending perpendicularly from the thin edge of the wedge to the center area of the wedge. The handle extends outward perpendicularly from a central portion of the thick side of the wedge. A preferred embodiment includes rounded ridges that run parallel to the front surface and start as a small radius and progress to larger radius.

U.S. Pat. No. 5,249,776 issued 5 Oct. 1993 to Johnson, is for an adjustable leverage claw hammer for providing increased leverage when removing nails of various lengths. The claw hammer includes a standard hammer head mounted on one end of a handle. The hammer head has a first end with a striking surface for engaging nails and a second end forming a pair of claws used for removing nails. The hammer head has a "U" shaped cap assembly rotatably pinned thereon. The cap assembly has a convex shaped top portion disposed above the top of the hammer head which acts as a fulcrum for engaging a working surface having a nail driven therein. Extending downwardly from the top portion of the cap assembly is a pair of side plates having a plurality of detent teeth disposed along an interior surface of the side plates. The detent teeth are positioned adjacent opposite sides of the hammer head. A slot is cut through a portion of the second end of the hammer head and adjacent the claws. The slot is used to receive a spring biased lock assembly. A portion of the lock assembly is received inside grooves between the detent teeth of the cap assembly. By adjusting the lock bar in a selected groove between the detent teeth, the cap assembly can be raised and lowered above the hammer head for adjusting leverage of the claw hammer when removing nails of various lengths from the working surface.

U.S. U.S. Pat. No. 5,060,911 issued 29 Oct. 1991 to Mikesell, indicates a claw hammer including a fulcrum repositioning and/or lever arm lengthening extension which may be releasably mounted at the distal, hammer head, end of the hammer for use in pulling nails and also releasably mounted at the proximal end of the hammer handle for storage.

What is needed is to provide a single leverage enhancement attachment for any of a wide variety of lever tools, which slips easily onto and off any of the lever tools and is easily carried in a toolbox or tool belt.

BRIEF SUMMARY OF THE INVENTION

An object of the present invention is to provide a single leverage enhancement attachment for any of a wide variety of lever tools to improve the tool's angle of attack and increase the leverage power, which attachment slips easily onto and off any of the lever tools and is easily carried in a toolbox or tool belt.

In brief, the present invention provides a leverage enhancement attachment for any of a wide variety of lever tools which produces a variable increased angle of attack and greater leverage thereby reducing the force needed to extract embedded fasteners, separate work objects, or adjustably lift heavy or unwieldy work pieces. Used in conjunction with lever tools structured to extract fasteners, separate, move, or adjustably lift work pieces, the present invention compliments and increases the lever tools functionality and force to perform tasks not normally possible with most hand-held lever tools alone.

The lever enhancement block of the present invention attaches to any of a wide variety of existing lever tools in multiple methods by the use of a harness or pivoting attachment loop to removably connect the lever enhancement block to a lever tool and further preferably uses magnets between the block and a metal tool in order to stabilize and hold the block in place so that the lever tool and the lever enhancement block work together as a single unit.

The present invention comprises a high-compression strength body configured in a multiple-sided block shape having a tool contacting face conforming to the shape of a lever support surface contacting face of the tool (preferably flat), a multi-faced and/or curved surface opposite the tool contacting face for contacting the external lever support surface, two substantially flat opposing side faces both orthogonal to the tool contacting face, and a harness, adjustable belt, or metal loop having ends pivotally connected to the two side faces adjacent to the tool contacting face and a loop configuration for slipping over a work contacting end of a lever element on the lever tool adjacent to the work contacting end so that the loop secures the leverage enhancement block to the lever tool with the tool contacting face against the lever tool so that the working end of the lever element engages a work contact point in the work surface at a steeper angle and the lever tool pivots to perform the leverage task with greater ease provided by the increased leverage afforded by the leverage enhancement block separating the lever tool from the work surface creating an increased leverage to perform the leverage task with more force applied than that afforded by the lever tool alone. At least one magnet may be attached to or embedded in the tool contacting face to further secure the block to a metal lever tool. The leverage enhancement block may be fabricated of any high-compression strength material including metal, hard rubber, a molded synthetic structure, wood, or other material having a high compressive strength.

The tool contacting surface is preferably flat with the magnet(s) centered thereon. The harness or loop is centered relative to the ends of the tool contacting face and attached on both sides of the block, leaving enough space between the outer portion of the harness or loop for the working end portion of the lever tool element to slip through the harness or loop. The block may be configured with eight flat faces with circular corners or may have a circular outer edge surface for contacting the external lever support surface.

Magnet(s) may be attached or embedded on two end faces orthogonal to the tool contacting face, one end face at each end of the tool contacting face in order to grip fasteners as they are extracted and keep them in place until removed by operator.

When the present invention is attached to the lever tool, the present invention and the lever tool act as one unit (for potential one handed use) in order to accomplish and complete the leverage task.

The loop may be fabricated of a very strong strip of flexible material or a metal rod structured preferably in a rectangular configuration with three sides pivoting to loop over the working end of the extractor tool and the fourth side having a missing middle section so that a peg pointing inwardly from each of the two opposing sides fits into an opening in each side face of the block adapted for pivotally receiving the loop therein. The loop pivots through 180 degrees (or through a full 360 degrees) to accommodate a wide variety of shapes and sizes of lever tools or working level ends of multi-purpose tools.

Each of the two sides of the block provides a flat surface to accommodate indicia for advertising or instructional purposes.

Fasteners to be extracted on an extractor-type lever tool can include: screws, staples, nails, spikes, bolts, pins, tacks, butter fly clips, wall anchors, embedded wire, or any other type of embedded fastener or surface embedded ornament or element to be removed from a work surface.

The present invention may be attached to any of a variety of lever tools including: claw hammers, crowbars, cat paws, flat pry bars, screwdriver pry bars, ripping bars, multifunction bars, wrecking bars, handy bars, wonder bars, RSC bars, or any other type of lever tools or lever portion of a multi-purpose tools.

The leverage enhancement block of the present invention may be structured with recesses or compartments used as storage space or to receive attached accessories including lighting devices, laser devices (such as laser levels), bubble levels, nail/fastener finder (although the existing magnets can act as a locator/finder and fastener grip), tape measure, tack, hook and loop fastener fabric, zip tie, adhesive material, pencil, pencil sharpener, electronic transmitter/receiver, or any of a variety of other work-related items. The magnets on the leverage enhancement block of the present invention may be used to attach the leverage enhancement attachment to an exterior of a metal toolbox or used to attach putty knives, chisels, pliers, screwdrivers, or other small metal tools on the exterior of the leverage enhancement block.

Many tasks requiring a lever tool may be greatly improved by the leverage enhancement block attached to a lever tool such as prying work elements apart, removing molding or other building components, moving heavy furniture, holding door up while installing hinges, or any other tasks using a lever tool.

The end face magnet of the block of the present invention may be used to hold a nail in place with the block resting on a horizontal work surface for tapping the nail in to start it with the hammer head and then driven in with one hand. To extract the nail, the claw of the hammer is hooked into the attachment loop and used for extraction of the nail using only one hand in the operation. This one-handed method could be used for occupational therapy, teaching and re-teaching skills (physical therapy) for people with arm injuries or loss of one arm, particularly for returning Veterans. The method is useful for hand eye coordination and muscle building, using the invention to perform a skill with one hand.

A distinct advantage of the present invention is that it enables a lever tool to apply more leverage force with greater ease provided by the increased leverage afforded by the block separating the lever tool from the external lever support surface and by providing a greater attack angle for the working end of the lever element on the lever tool to contact the external work element.

BRIEF DESCRIPTION OF THE SEVERAL VIEWS OF THE DRAWINGS

These and other details of the present invention will be described in connection with the accompanying drawings, which are furnished only by way of illustration and not in limitation of the invention, and in which drawings.

DETAILED DESCRIPTION OF THE INVENTION

Figure 1:
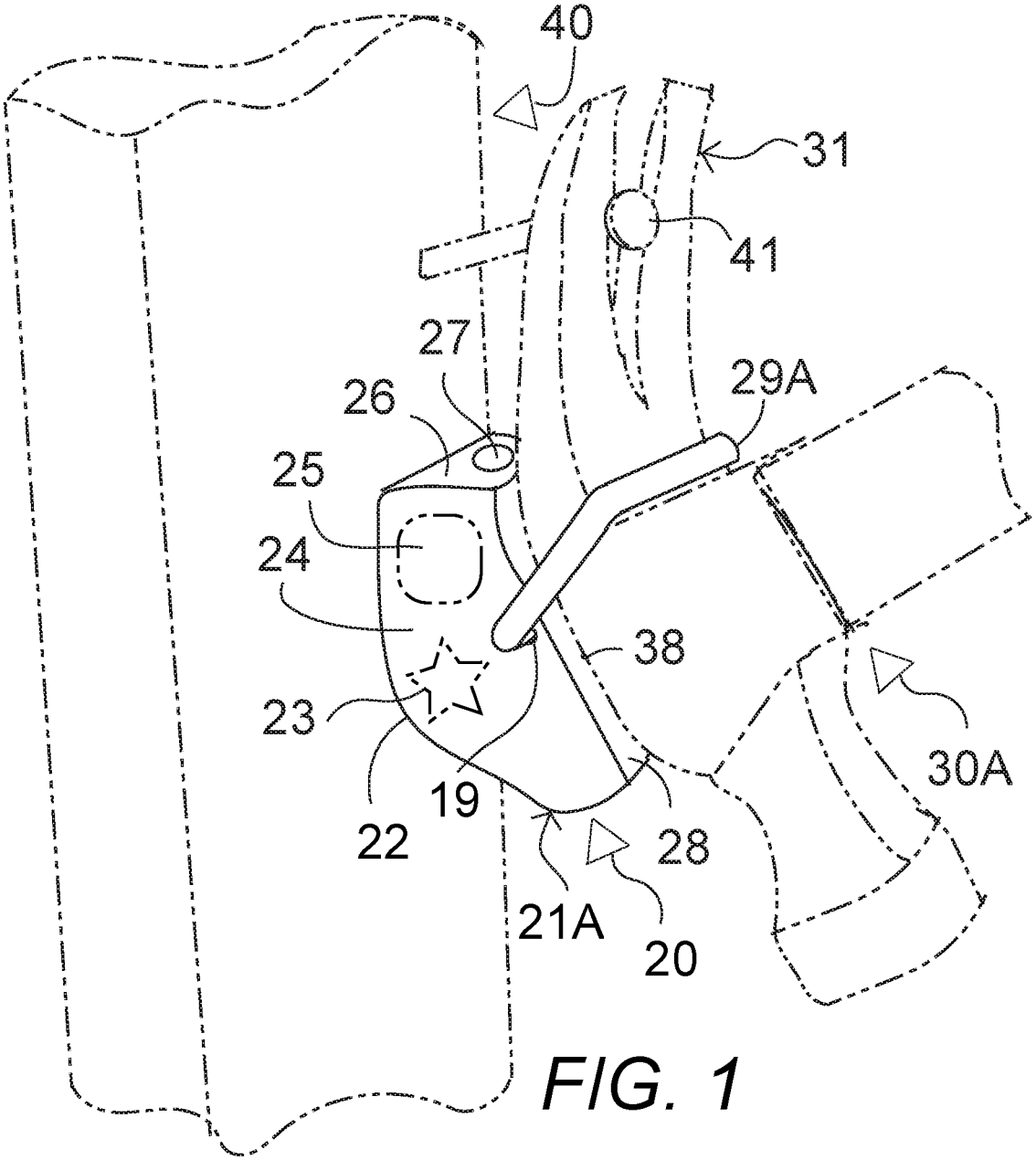
FIG. 1 is a perspective view of the leverage enhancement attachment of the present invention attached to a claw hammer pulling out a nail showing the block against a vertical board and the loop hooked over the hammer adjacent to the claw portion.
Figure 2:
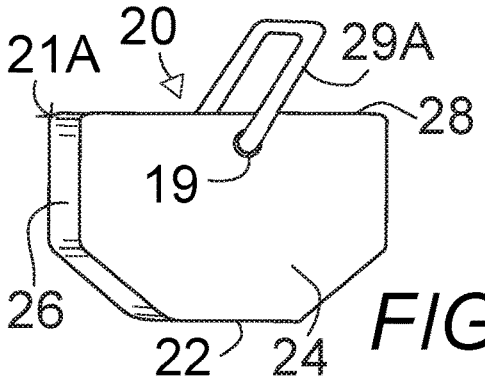
FIG. 2 is a perspective view of the leverage enhancement attachment of the present invention showing a bottom lever support contacting face having three approximately equal angled flat surfaces on the block and a top metal rod rectangular attaching loop.
Figure 6:
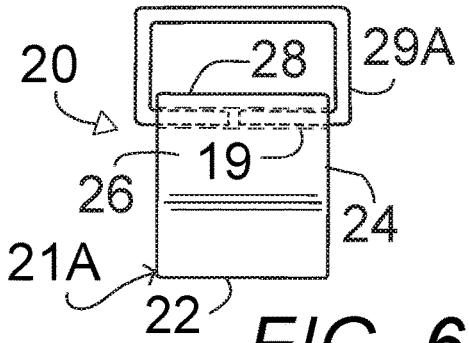
FIG. 6 is an elevational end view of the block of FIG. 2 showing the interior receiving opening and two ends of the attaching loop inserted in the opening in dashed lines.
Figure 3:
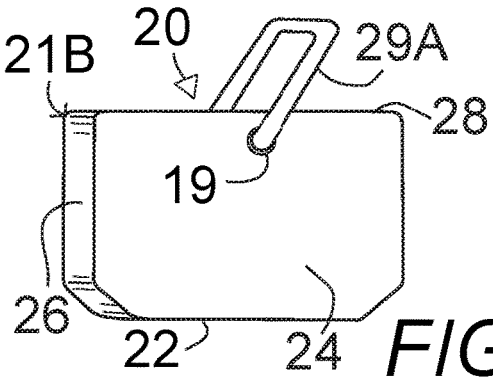
FIG. 3 is a perspective view of the leverage enhancement attachment of the present invention showing a bottom lever support contacting face having one long flat middle surface and two small angled flat end surfaces on the block and a top metal rod rectangular attaching loop.
Figure 7:
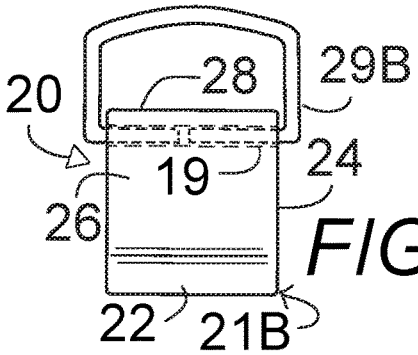
FIG. 7 is an elevational end view of the block of FIG. 3 showing the interior receiving opening and two ends of a curved attaching loop inserted in the opening in dashed lines.

In FIGS. 1-12, the present invention comprises a leverage enhancement attachment 20 for any of a wide variety of lever tools 30A and 30B to produce a variable increased angle of attack and greater leverage.

A high-compression strength leverage enhancement attachment block 21A, 21B, 21C, 21D comprises a tool contacting face 28 substantially conformable to the shape of a lever tool 30A, 30B support contacting surface 38 for attachment thereto. An attachment block lever support contacting face 22 opposite to and spaced apart from the tool contacting face 28 for variable angled contact with an external lever support surface 40.

Two substantially flat opposing side faces 24 extend between the tool contacting face 28 and the attachment block lever support contacting face 22. An attaching loop 29A, 29B, 29C, 29D having ends pivotally connect to the two side faces 24 adjacent to the tool contacting face 28.

Figure 10:
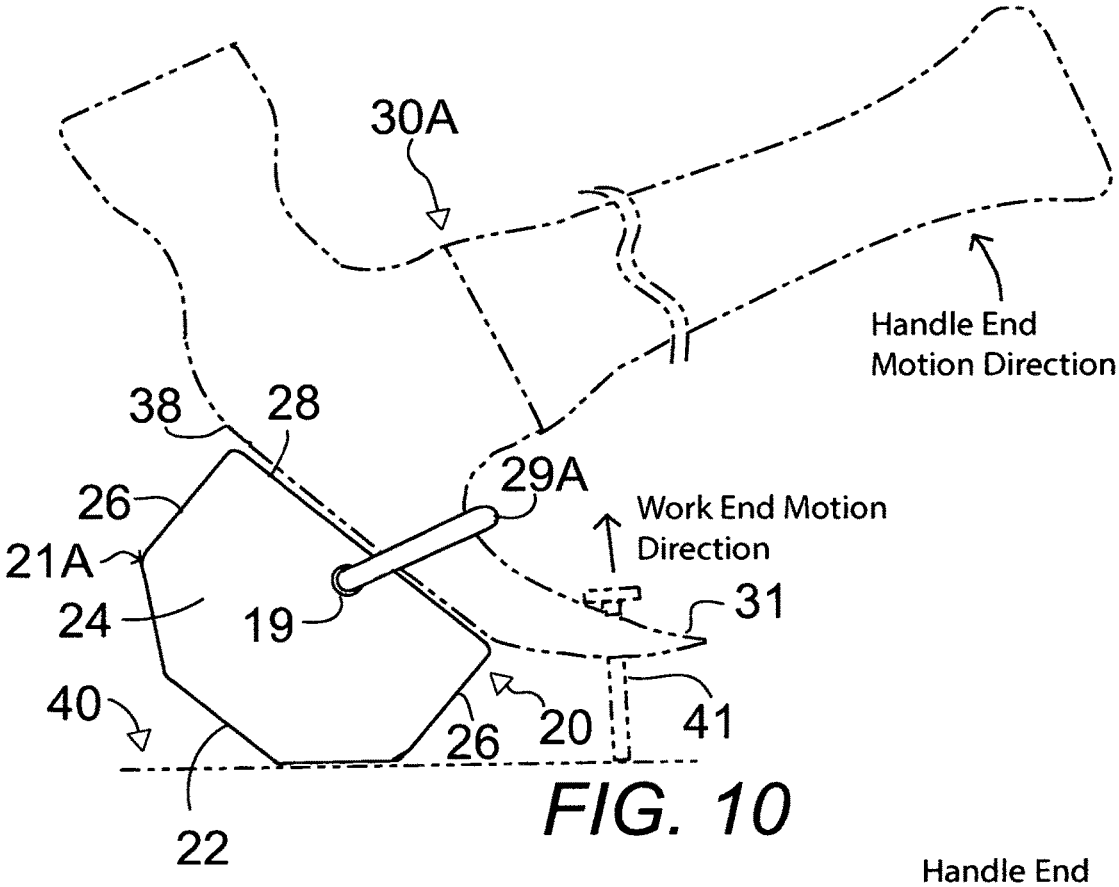
FIG. 10 is a side elevational view of the leverage enhancement attachment of the present invention attached to a claw hammer pulling out a nail showing the block of FIG. 2 against a horizontal board and the loop hooked over the hammer adjacent to the claw portion.
Figure 11:
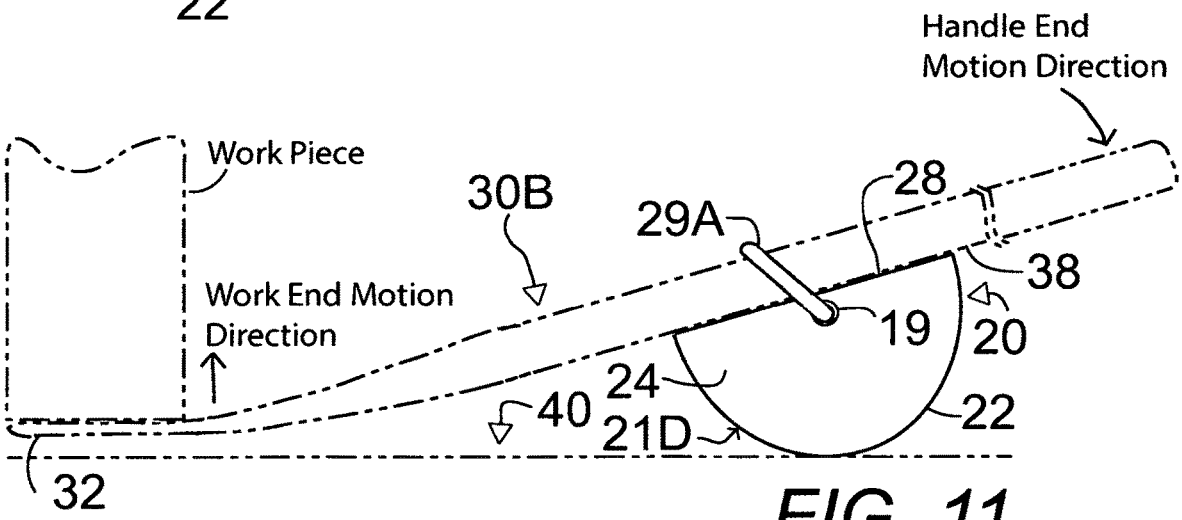
FIG. 11 is a side elevational view of the leverage enhancement attachment of the present invention attached to a leverage bar at a flat lever end showing the circular curved block of FIG. 5 against a horizontal board and the loop hooked over the leverage bar adjacent to the flat lever end shown elevating a door or vertical element.

In FIGS. 1, 10, and 11, the attaching loop 29A is adapted for slipping over a working end 31 and 32 of a lever element on any of a variety of lever tools 30A and 30B. The attaching loop is attached to pivot through a sufficiently wide angular range adapted to position the loop 31 and 32 into engagement with a portion of the lever tool 30A and 30B to rigidly secure the attachment block 21A and 21D to the lever tool during use. The leverage enhancement attachment 20 is adapted to provide a variable steeper angle of attack of the working end of the lever tool and create a more distant lever support from the work surface to increase the leverage force of the lever tool to enable greater ease and greater force applied than that afforded by the lever tool alone.

Figure 4:
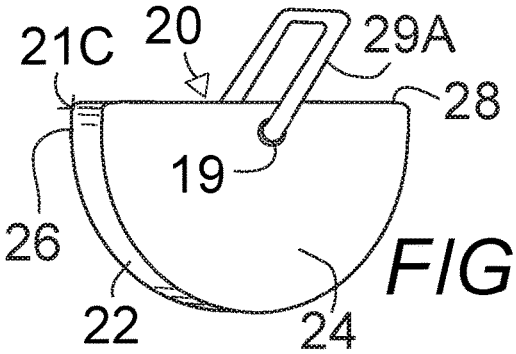
FIG. 4 is a perspective view of the leverage enhancement attachment of the present invention showing a bottom elongated curved lever support contacting face on the block and a top metal rod rectangular attaching loop.
Figure 5:
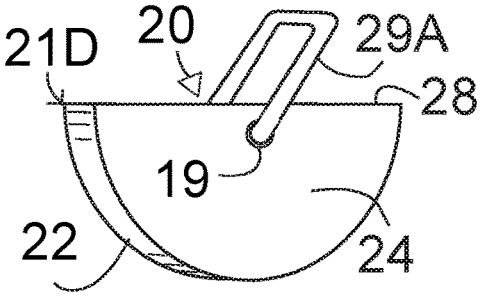
FIG. 5 is a perspective view of the leverage enhancement attachment of the present invention showing a bottom circular curved lever support contacting face on the block and a top metal rod rectangular attaching loop.

The attachment block lever support contacting face 22 may comprise a multiplicity of adjacent variably angled flat surfaces, as shown in FIGS. 1, 2, 3, 9, 10 and 12 to enable the lever enhancement attachment block to engage the external lever support surface at a variety of angles for varying the attack angle of the attached lever tool and to variably increase the leverage force. The attachment block lever support contacting face 22 may alternately comprise a curved surface, as shown in FIGS. 4, 5, and 11 to enable the lever enhancement attachment block to engage the external lever support surface at a full range of variable angles for varying the attack angle of the attached lever tool and to variably increase the leverage force.

Figure 9:
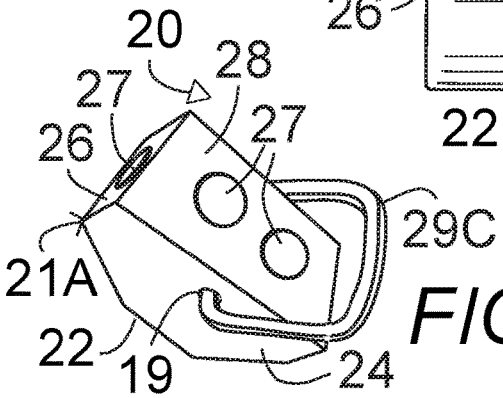
FIG. 9 is a perspective view of the block of FIG. 2 showing two magnets attached to the flat tool contacting face, one magnet attached to an end face and a curved top attaching loop fabricated from a rectangular metal rod.
Figure 12:
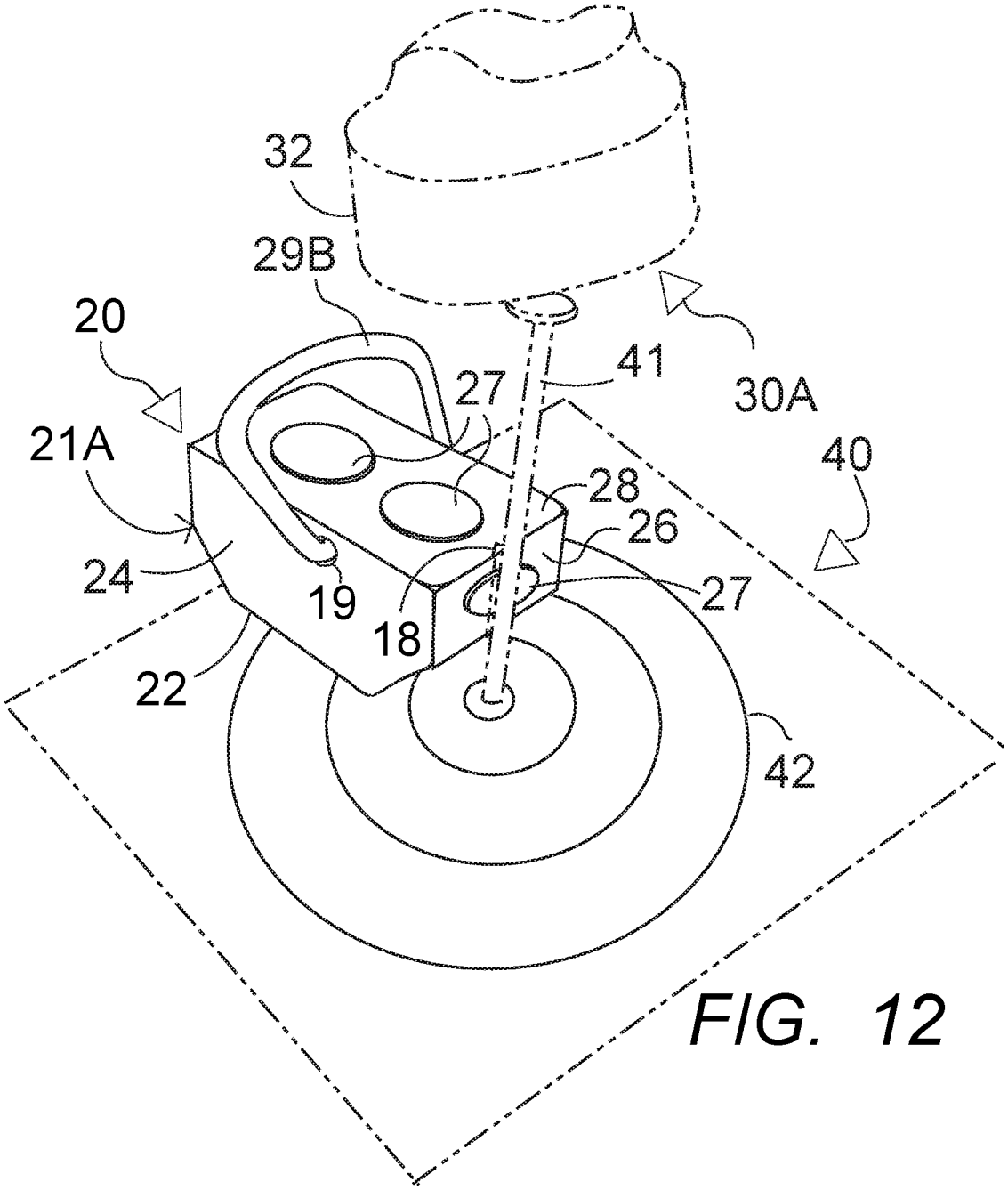
FIG. 12 is a perspective view of the block of FIG. 9 showing two magnets attached to the flat tool contacting face, one magnet attached to an end face and a curved top attaching loop fabricated from a circular metal rod showing the end face magnet of the block holding a nail in place on a wooden horizontal surface bearing a bulleye indicia for use in a one-handed therapeutic exercise of pounding in a nail accurately followed by slipping the claw end of the hammer through the loop of the block to extract the nail.

In FIGS. 1, 9, and 12, at least one magnet 27 is attached to or embedded in the tool contacting face 28 to stabilize and further secure the connection of the attachment block to the lever tool. When the tool contacting face 28 is substantially flat, the at least one attached magnet 27 is further adapted for removably attaching the attachment block to a metal tool chest for storage and transport.

The attachment block 21A further comprises two end faces 26 orthogonal to the tool contacting face 28 at two ends of the side faces 24 and at least one magnet 27 attached to each of the end faces 26 adjacent to the tool contacting face 28 for use with a fastener extracting lever tool, such as a claw hammer 30A or any type of lever bar 30B having a fastener extraction claw 31, to grip metal fasteners 41 as they are extracted and keep them held by the at least one magnet 27 after extraction.

In FIG. 12, the magnet 27 on one of the end faces 26 works in conjunction with a vertical recess 18 adapted for holding a nail 41 in place with the attachment block 21A resting on a work surface 40 for pounding in the nail 41 with one-handed use of the hammer 30A and hooking a claw end of the hammer into the attachment loop for extracting a nail 41, as shown in FIG. 10. The block 21A holding a nail 41 in place on the wooden horizontal surface 40 bearing a bulleye indicia 42 may be used in a one-handed therapeutic exercise of pounding in a nail accurately followed by the nail extraction.

The attachment block 21A, 21B, 21C, 21D may be fabricated from any of a variety of high-compression strength materials taken from the list of high-compression materials including metal, hard rubber, molded high-compression synthetic material, nylon, or wood.

Figure 8:
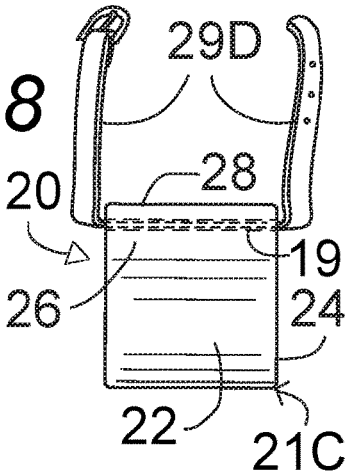
FIG. 8 is an elevational end view of the block of FIG. 3 showing the interior receiving opening in dashed lines and a high tensile strength adjustable belt attaching loop inserted through the opening.

The loop 29A, 29B, 29C is attached to a center portion of each of the two sides adjacent to the tool contacting surface. The attachment loop is adapted to be rotatable and the loop is of sufficient length to accommodate a variety of lever tools 30A and 30B inserted therein. The loop may be fabricated of any of a variety of strong tensile non-stretch materials taken from the list of strong tensile non-stretch materials including a strip of strong tensile non-stretch flexible material, an adjustable belt of strong non-stretch material as shown in FIG. 8, a rigid rod bent into a loop, a metal rod of rectangular cross-section bent into a rectangular configuration, a metal rod of circular cross-section bent into a rectangular configuration, or a strong tensile strength synthetic material molded in a loop or extruded and bent into a loop.

In FIG. 1, the attachment block 21A further comprises indicia 23 on at least one of the two sides 24 of the attachment block adapted for advertising or instructional purposes.

The leverage enhancement attachment 20 of the present invention may be attached to any of a variety of lever tools taken from a list of lever tools including claw hammers, crowbars, cat paws, flat pry bars, screwdriver pry bars, ripping bars, multifunction bars, wrecking bars, handy bars, wonder bars, RSC bars, and multi-function tools having a lever tool.

The leverage enhancement attachment 20 may be removably attached to a fastener extracting lever tool adapted for extraction of any of a variety of fasteners taken from a list of fasteners including screws, staples, nails, spikes, bolts, pins, tacks, butterfly clips, wall anchors, embedded wire, and attached indicia.

In FIG. 1, the leverage enhancement block 20 of the present invention is configured with at least one recessed attachment or storage compartment 25 adapted to receive any of a variety of work accessories taken from the list of work accessories including a lighting device, a laser level, a bubble level, a nail/fastener finder, a tape measure, a pencil, a pencil sharpener, and an electronic transmitter/receiver, driver bits, tacks, and blades.

In use, the leverage enhancement attachment 20 of the present invention instantly attaches to any of a wide variety of lever tools to increase the attack angle and leverage of the lever tools for use in extracting fasteners, prying apart components, lifting work pieces, holding work pieces in place while installing, or any other job requiring a lever tool.

It is understood that the preceding description is given merely by way of illustration and not in limitation of the invention and that various modifications may be made thereto without departing from the spirit of the invention as claimed.

What is claimed is:

1. A leverage enhancement attachment for any of a wide variety of lever tools to produce a variable increased angle of attack and greater leverage, the attachment comprising:

a rigid leverage enhancement attachment block comprising a tool contacting face substantially conformable to the shape of a lever tool Support contacting surface for attachment thereto, an attachment block lever support contacting face opposite to and spaced apart from the tool contacting face for variable angled contact with an external lever support surface, two substantially flat opposing side faces extending between the tool contacting face and the attachment block lever support contacting face, an attaching loop having ends pivotally connected to the two side faces adjacent to the tool contacting face, the attaching loop adapted for slipping over a working end of a lever element on any of a variety of lever tools, the attaching loop attached to pivot through a sufficiently wide angular range adapted to position the loop into engagement with a portion of the lever tool to rigidly secure the attachment block to the lever tool during use, the leverage enhancement attachment adapted to provide a variable steeper angle of attack of the working end of the lever tool and create a more distant lever support from the work surface to increase the leverage force of the lever tool to enable greater ease and greater force applied than that afforded by the lever tool alone;

and further comprising two end faces orthogonal to the tool contacting face at two ends of the side faces and a least one magnet attached to each of the end faces adjacent to the tool contacting face for use with a fastener extracting lever tool to grip metal fasteners as they are extracted and keep them held by the at least one magnet after extraction.

2. The attachment of claim 1 wherein the attachment block lever support contacting face comprises a multiplicity of adjacent variably angled flat surfaces adapted to enable the lever enhancement attachment block to engage the external lever support surface at a variety of angles for varying the attack angle of the attached level tool and to variably increase the leverage force.

3. The attachment of claim 1 further comprising at least one magnet attached to the tool contacting face to stabilize and further secure the connection of the attachment block to the lever tool.

4. The attachment of claim 3 wherein the tool contacting face is substantially flat and the at least one attached magnet is adapted for removably attaching the attachment block to a metal tool chest for storage and transport.

5. The attachment claim 1 wherein the at least one magnet on one of the end faces is adapted for holding a pail in place with the attachment block resting on a work surface for pounding in the nail with one-handed use of the hammer and hooking a claw end of the hammer into the attachment loop for extracting a nail.

6. The attachment of claim 5 further comprising a vertical recess on the at least one of the end faces adapted for working in conjunction with the at least one magnet for holding the nail in place.

7. The attachment of claim 1 wherein the attachment block is fabricated from any of a variety of rigid materials taken from the list of rigid materials including metal, hard rubber, molded rigid synthetic material, nylon, and wood.

8. The attachment of claim 1 wherein the loop is attached to a center portion of each of the two sides adjacent to the tool contacting surface, the loop adapted to be rotatable the loop being of sufficient length to accommodate a variety of lever tools inserted therein, the loop being fabricated of any of a variety of non-stretch materials taken from the list of non-stretch materials including a strip of non-stretch flexible material, an adjustable belt of non-stretch material, a rigid rod bent into a loop, a metal rod of rectangular cross-section bent into a rectangular configuration, a metal rod of circular cross-section bent into a rectangular configuration, and a non-stretch synthetic material molded in a loop or extruded and bent into a loop.

9. The attachment of claim 1 further comprising indicia on at least one of the two sides of the attachment block adapted for advertising or instructional purposes.

10. The attachment of claim 1 wherein the leverage enhancement attachment is adapted to be attached to any of a variety of lever tools taken from a list of lever tools including claw hammers, crowbars, cat paws, flat pry bars, screwdriver pry bars, ripping bars, multifunction bars, wrecking bars, handy bars, wonder bars, RSC bars, and multi-function tools having a lever tool.

11. The attachment of claim 1 wherein the leverage enhancement attachment is adapted to be removably attached to a fastener extracting lever tool adapted for extraction of any of a variety of fasteners taken from a list of fasteners including screws, staples, nails, spikes, bolts, pins, tacks, butterfly clips, wall anchors, embedded wire, and attached indicia.

12. The attachment of claim 1 wherein the leverage enhancement block is configured with at least one recessed storage compartment adapted to receive any of a variety of work accessories taken from the list of work accessories including a lighting device, a laser level, a bubble level, a nail/fastener finder, a tape measure, a pencil, a pencil sharpener, and an electronic transmitter/receiver, driver bits, tacks, and blades.

13. The attachment of claim 1 wherein the leverage enhancement block of the present invention is configured with at least one recess adapted to receive any of a variety of work accessories installed therein taken from the list of work accessories including a lighting device, a laser level, a bubble level, a nail/fastener finder, a tape measure, a pencil, a pencil sharpener, and an electronic transmitter/receiver.

* * * * *